US006335521B1

(12) United States Patent
Jeong et al.

(10) Patent No.: US 6,335,521 B1
(45) Date of Patent: Jan. 1, 2002

(54) MICROWAVE OVEN

(75) Inventors: Sang-jin Jeong; Kwang-il Yang, both of Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/761,856

(22) Filed: Jan. 18, 2001

(30) Foreign Application Priority Data

Oct. 11, 2000 (KR) ..... 00-59845

(51) Int. Cl.[7] ..... H05B 6/80

(52) U.S. Cl. ..... 219/757; 219/702; 126/299 D; 454/333

(58) Field of Search ..... 219/757, 702, 219/681, 400; 126/21 A, 299 D; 454/222, 236, 333, 334

(56) References Cited

U.S. PATENT DOCUMENTS 4,796,384 A * 1/1989 Warwick ..... 49/55
4,932,160 A 6/1990 Sperko ..... 49/254
5,232,402 A * 8/1993 Lorenzon ..... 454/222
5,375,374 A 12/1994 Rohroff, Sr. ..... 49/340
6,196,914 B1 * 3/2001 Lyu ..... 454/153

FOREIGN PATENT DOCUMENTS

JP 10220094 8/1998

* cited by examiner

*Primary Examiner*—Philip H. Leung
(74) *Attorney, Agent, or Firm*—Robert E. Bushnell Esq.

(57) ABSTRACT

A microwave oven comprising a main body formed with a cooking compartment, an outer casing surrounding the main body, to define an outer appearance of the microwave oven, a grill member provided between the main body and the outer casing, having a number of air passing holes, and a grill cover rotatably provided in front of the grill member, opening and closing the grill member, further comprising a main cam rotatably contacting with a rear face portion of the grill cover; a motor moving the main cam; and a switch sensing a rotational position of the main cam, the rotational position of the main cam being controlled to control the opening/closing operation of the grill cover when the motor operates. With this configuration, the switching operation is facilitated, the range of switching operation is constant, and the cost of production is reduced.

17 Claims, 7 Drawing Sheets

MICROWAVE OVEN

CLAIM OF PRIORITY

This application makes reference to, incorporates the same herein, and claims all benefits accuring under 35 U.S.C. §119 from my application MICROWAVE OVEN filed with the Korean Industrial Property Office on Oct. 11, 2000 and there duly assigned Serial No. 59845/2000.

BACKGROUND OF THE INVENTION

1. Field of the Invention

The present invention relates in general to microwave ovens, and more particularly, to a microwave oven having an improved grill cover.

2. Description of Related Art

Referring to FIG. 6 which is an exploded perspective view of a conventional wall-mounted microwave oven, the conventional microwave oven is comprised of a main body 101 formed with a cooking compartment 103, and an outer casing 105 surrounding the main body 101, to define an outer appearance of the microwave oven.

A tray 107 upon which food rests is placed within the cooking compartment 103. In front of the cooking compartment 103 is installed a door 109 opening and closing the cooking compartment 103, through which a user can put in and pick out the food. Beside the door 109 is installed a control panel 111 formed with a plurality of buttons by which the user can control the microwave oven. In the rear of the control panel 111 is installed a magnetron 115 supplying electromagnetic waves into the cooking compartment 103.

The outer casing 105 is comprised of an upper casing 117, a lower casing 121 and a rear casing 119. The upper casing 117 takes a shape of inverse 'U,' surrounding the upper part and both side parts of the main body 101, the lower casing 121 is installed in the lower of the main body 101 and the rear casing 119 is installed in the rear of the main body 101.

On the lower casing 121 are installed a pair of air inlet ports 127 and a pair of hood lamps 129. Through the air inlet ports 127, air flows into the lower casing 121, according to operation of a blowing fan 125 installed to the rear casing 119, and the hood lamps 129 is installed adjacent to the air inlet ports 127, to illuminate below the microwave oven.

On the top face of the upper casing 117 is formed an exhaust port 123 through which the air drawn through the air inlet ports 127 is exhausted outside the main body 101. Between the upper of the main body 101 and the upper casing 117 is formed a grill member 135 having a number of air passing holes 133. On the top of the main body 101 is formed a holding bracket 131 holding the grill member 135. In front of the grill member 135 is provided a grill cover casing 141, taking a shape of rectangular box, having longitudinal openings in the front face and the rear face thereof. In the front opening of the grill cover casing 141 is installed a grill cover 143. Between the grill member 135 and the grill cover 143 is provided a switch 161 opening and closing the grill cover 143 installed in the front opening of the grill cover casing 141.

FIG. 7 is a partial, sectional view showing an assembly of the grill cover 143 and the switch 161 taken along line VII—VII of FIG. 6, and FIG. 8 is a view showing an operation state of the grill cover of FIG. 6. As shown therein, the grill cover casing 141 is comprised of an inclination part 142 downwardly inclined toward the inside of the front opening thereof, with a predetermined inclination degree.

On the outer upper surface of the grill cover casing 141 is formed an indentation part 141*a* indented from the surface thereof to a predetermine depth. On the outer lower plate of the grill cover casing 141 is formed a protrusion part 141*b* protruded transversely relative to the lower plate thereof. The grill cover casing 141 is allowed to closely contact an upper portion of the main body 101 and a lower surface of the upper casing 117 by means of the indentation part 141*a* and the protrusion part 141*b*. On the grill cover 143 installed in the front opening of the grill cover casing 141 is formed a link supporter 147 protruded toward the grill member 135 transversely, relative to the grill cover 143.

The link supporter 147 has an elongated guide hole 147*a* (see FIG. 8) formed in the lengthwise direction thereof. On opposite sides of the rear lower portion of the grill cover 143 is provided a hinge 149 coupled to the grill cover casing 141, opening and closing the front opening of the grill cover casing 141. In the middle of the grill cover casing 141 is formed a bracket 165 taking a shape of inverse 'U.' One side of the bracket 165 is opened and the other side thereof is coupled to the grill member 135. The switch 161 opening and closing the grill cover has a step motor 163 having a rotational shaft to drive of opening and closing of the grill cover 143, and a link shaft 167 coupled to the rotational shaft of the step motor 163. The step motor 163 is coupled to an external side of the bracket 165. On one end of the link shaft 167 is formed a motor shaft accommodating part 167*a* coupled to the rotational shaft of the step motor 163. On the other end of the link shaft 167 is formed a connection pin 167*b* connected to the elongated guide hole 147*a* of the link supporter 147.

The connection pin 167*b* is accommodated in the elongated guide hole 147*a*, so as to slidably elevate along the elongated guide hole 147*a*. When the grill cover 143 is closed, the connection pin 167*b* is placed in the upper side of the elongated guide hole 147*a* of the link supporter 147.

Referring to FIG. 8 again, in the case that the grill cover 143 is opened, if the step motor 163 is activated for a predetermined period of time according to a signal from a controller (not shown), so that, for example, the motor shaft is rotated counterclockwise in view of the motor 163, the link shaft 167 coupled to the rotational shaft of the step motor 163 is rotated counterclockwise. If the link shaft 167 is rotated counterclockwise, the connection pin 167*b* of the link shaft 167 is slid downward along the elongated guide hole 147*a*. If the connection pin 167*b* is slid downward, the grill cover 143 is forward rotated, to thereby open the front opening of the grill cover casing 141. After a predetermined period of time has passed, the controller (not shown) activates the step motor 143 to stop its operation. If the step motor 163 stops, the grill cover 143 remains in the maximally opened state. At this time, the step motor shaft connected to the link shaft 167 supports the weight of the grill cover 143.

In the case that the opened grill cover 143 is closed, if the rotational shaft of the step motor 163 is rotated clockwise by a control signal from the controller (not shown), the link shaft 167 coupled to the rotational shaft of the step motor 163 is rotated clockwise. If the link shaft 167 is rotated clockwise, the connection pin 167*b* of the link shaft 167 is slid upward along the elongated guide hole 147*a* of the link supporter 147. If the connection pin 167*b* is slid upward, the grill cover 143 is rotated backward, to thereby close the front opening of the grill cover casing 141. After a predetermined period of time has passed, the controller (not shown) activates the step motor 163 to stop its operation. If the step motor 163 stops, the grill cover 143 is closed. That is, the step motor 163 draws the grill cover 143 connected to the link shaft 167 by the rotation of the rotational shaft of the step motor 163.

In the conventional microwave oven, while the operation to open the grill cover is being conducted, the weight of the grill cover is to be supported by the rotational shaft of the motor, thereby generating an excessive burden to the rotational shaft. Further, while the operation to close the grill cover is being conducted, the grill cover is to be drawn by the rotation force of the motor, thereby generating an overload to the motor.

To open and close the grill cover, the motor has to be rotated reciprocally rather than unidirectionally, and frequent reciprocation of the motor is likely to cause the motor to be out of order. To open and close the grill cover, the connection pin connected to the link shaft should be slid up and down along the elongated guide hole of the link supporter, thereby preventing smooth open and close operations. In addition, since the grill cover is opened and closed by operating the motor for a predetermined period of time, it is not easy to maintain open and close range. Also, the conventional microwave oven requires a step motor that is more expensive than other motors, thereby increasing the cost of production.

SUMMARY OF THE INVENTION

Accordingly, the present invention has been made in view of the above-described shortcomings, and it is an object of the present invention to provide a microwave oven capable of smoothly opening and closing the grill cover, maintaining the open and close range, and reducing the cost of production.

This and other objects of the present invention may be achieved by a provision of a microwave oven comprising a main body formed with a cooking compartment, an outer casing surrounding the main body, to define an outer appearance of the microwave oven, a grill member provided between the main body and the outer casing, having a number of air passing holes, and a grill cover rotatably provided in front of the grill member, opening and closing the grill member, further comprising a main cam rotatably contacting with a rear face portion of the grill cover; a motor moving the main cam; and a switch sensing a rotational position of the main cam, the rotational position of the main cam being controlled to control the opening/closing operation of the grill cover when the motor operates.

The switch comprises a first micro switch operated to suspend the rotation of the main cam and the operation of the motor when the main cam is rotated to a predetermined degree to correspond to an open position of the grill cover; and a second micro switch operated to suspend the operation of the motor when the main cam is rotated to a predetermined degree from the open position, to correspond to a closed position of the grill cover.

The microwave oven further comprises first and second auxiliary cams to respectively activate the first and second micro switches when the main cam is rotated to correspond to the open and closed positions of the grill cover.

The main cam, the first auxiliary cam and the second auxiliary cam are provided coaxially. The microwave oven further comprises a spring provided at the rear of the grill cover, elastically biasing the grill cover from the open position to the closed position.

A reinforced steel plate is provided on the rear face of the grill cover, to prevent the grill cover from being deformed.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Hereinbelow, an embodiment of the present invention will be described in more detail with respect to a wall-mounted microwave oven, referring to the accompanying drawings.

Figure 1:
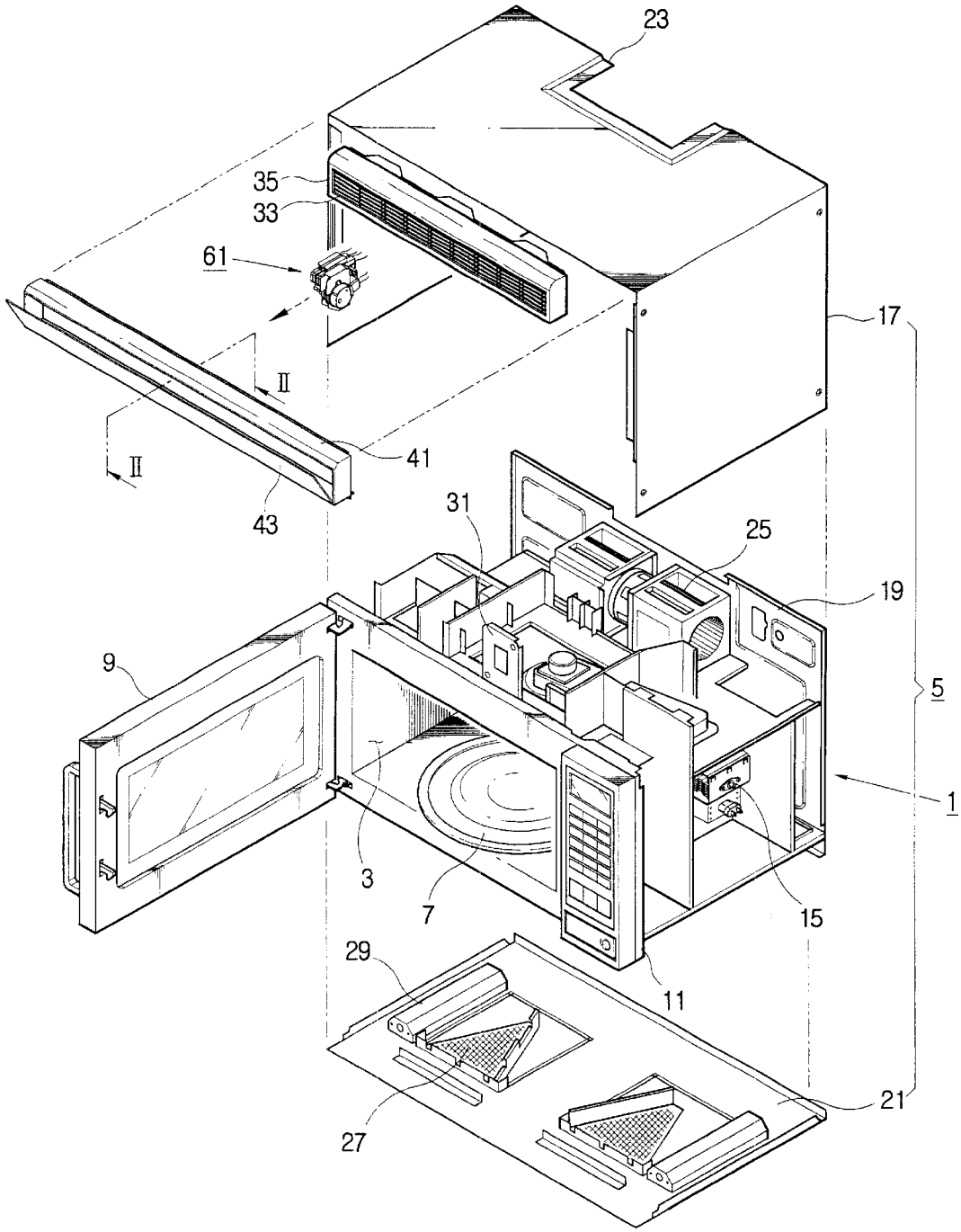
FIG. 1 is an exploded perspective view of a wall-mounted microwave oven according to the present invention.

Referring to FIG. 1, the wall-mounted microwave oven according to the present invention is comprised of a main body 1 formed with a cooking compartment 3 in which food is cooked, and an outer casing 5 surrounding an outside of the main body 1, to define an outer appearance of the microwave oven. Within the cooking compartment 5 is installed a tray 7 upon which food rests.

In front of the cooking compartment 3 is installed a door 9 opening and closing the cooking compartment 3, to allow a user to put in and pick out food to be cooked. Beside the door 9 is installed a control panel 11 having a number of buttons. In rear of the control panel 11 is installed a magnetron 15 supplying electromagnetic waves into the cooking compartment 5.

The outer casing 5 is comprised of an upper casing 17 surrounding the top and both sides of the main body 1, taking a shape of inverse 'U', a rear casing 19 installed in the rear of the main body 1 and a lower casing 21 installed in the lower of the main body. A space is formed between the top face of the main body 1 and the lower face of the upper casing 17 to allow air to pass through.

The lower casing 21 has an air inlet port 27 and a hood lamp 29. Air is drawn through the air inlet port 27 by an operation of a blowing fan 25 installed in the rear casing 19; and the hood lamp 29 is installed adjacent to the air inlet port 27, illuminating below the microwave oven.

On the top face of the upper casing 17 is formed an exhaust port 23 through which the air within the main body 1 and the air drawn in through the air inlet ports 27 are exhausted outside the main body 1. Between the upper of the main body 1 and the upper casing 17 is formed a grill member 35 having a number of air passing holes 33. Through the air passing holes 33, air is exhausted outside the main body 1 or outdoor air flows into the main body 1. On the top of the main body 1 is provided a holding bracket 31 holding the grill member 35. In front of the grill member 35 is provided a grill cover casing 41, having longitudinal openings in the front and rear thereof. To the front opening of the grill cover casing 41 is installed a grill cover 141 of a plate shape. Between the grill member 35 and the grill cover 43 is provided a switch 61 opening and closing the grill cover 43.

Figure 2:
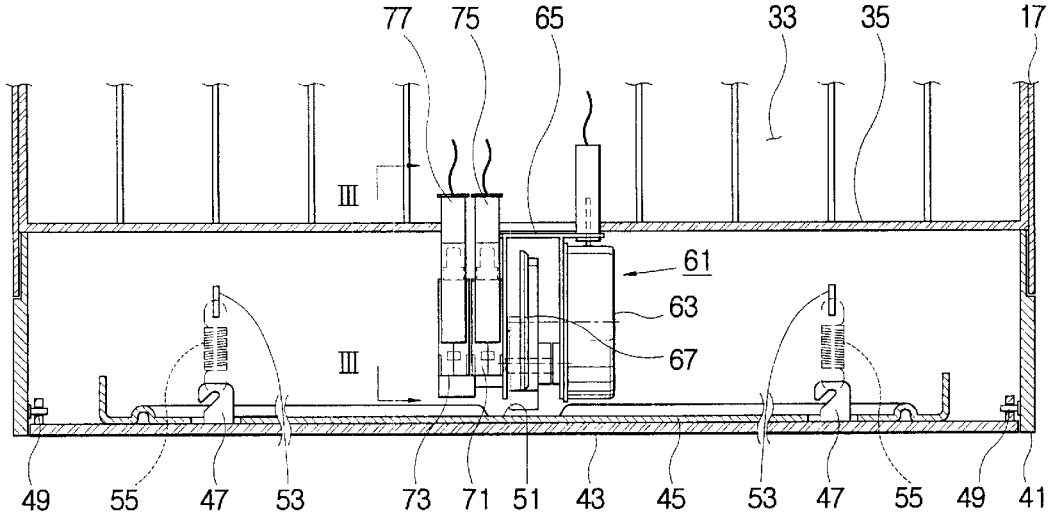
FIG. 2 is a partial sectional view showing an installation state of a grill cover and a switch of FIG. 1.
Figure 3:
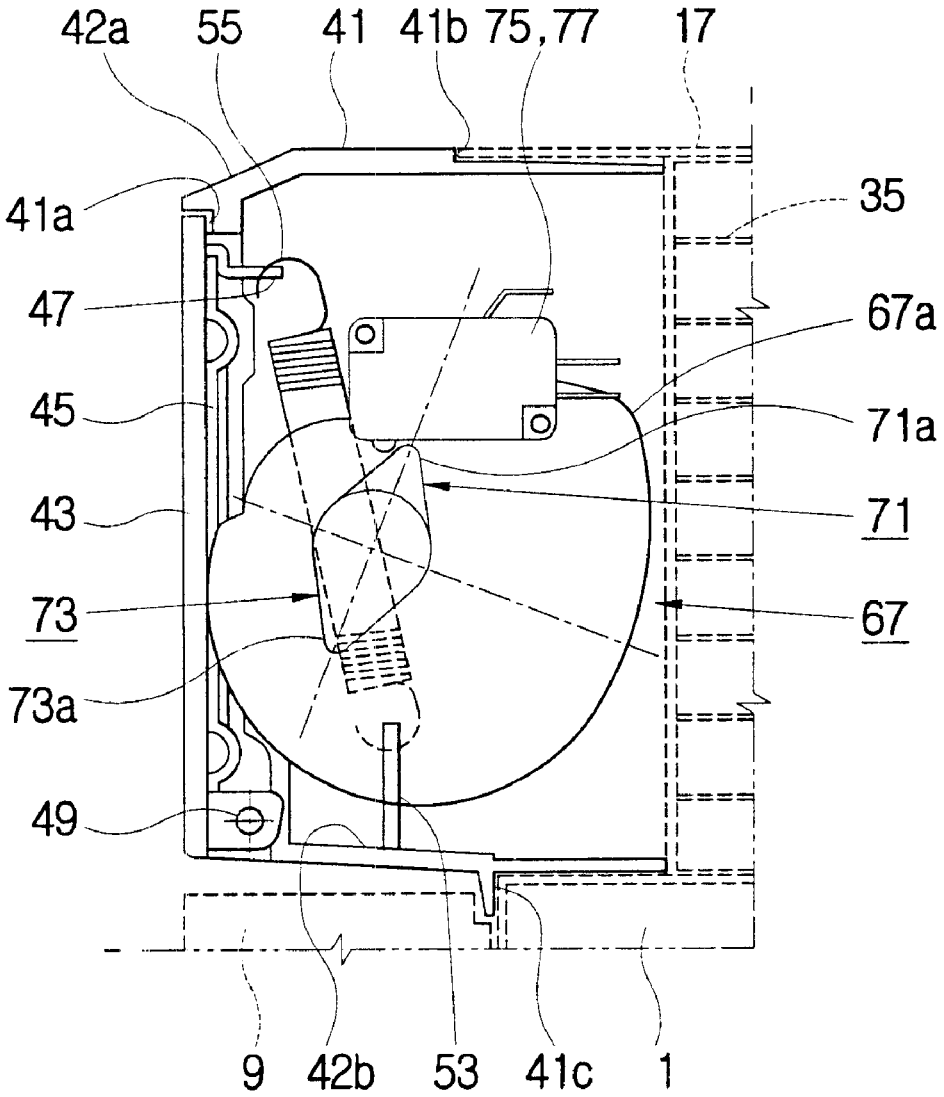
FIG. 3 is an enlarged sectional view taken along line—of FIG. 2.

Referring to FIGS. 2 and 3, the grill cover casing 41 is comprised of an inclination part 42*a* downwardly inclined toward the inside of the front opening thereof, with a predetermined inclination degree. On the upper surface of the grill cover casing 41 is formed an indentation part 41*b* indented from the surface thereof to a predetermine depth. On the lower surface of the grill cover casing 41 is formed a protrusion part 41*c* protruded from the surface thereof. The grill cover casing 41 is allowed to closely contact an upper portion of the main body 1 and a lower surface portion of the upper casing 17 by means of the indentation part 41*b* and the protrusion part 41*c*.

On the free end of the inclination part 42*a* of the grill cover casing 41 is formed a cover accommodating groove 41*a*, accommodating therein the upper end portion of the grill cover 43 when the grill cover is closed. On the rear face of the grill cover 43 is mounted a reinforcement plate 45 having predetermined length and width, to prevent the grill cover 43 from being deformed. On the rear upper face of the grill cover 43 are installed a pair of spring holders 47, taking a shape of ring. The spring holders are spaced with each other longitudinally relative to the grill cover 43. On opposite sides of the rear bottom face of the grill cover 43 are provided a pair of hinges 49 to be coupled to opposite sides of the lower part of the grill cover casing 41. The grill cover 43 is rotated around the hinges 49 to thereby open and close the front opening of the grill cover casing 41. In the middle of the rear face of the grill cover 43 is formed a main cam contact groove 51 indented to a predetermined depth. The main cam contact groove 51 is permanently in contact with an outer circumference of a main cam 67.

On an inner face of a second inclination part 42*b* formed in the lower of the grill cover casing 41 are formed a pair of spring couplers 53 corresponding to the spring holders 47. The spring couplers protrude from the planar surface of the grill cover 43. Between the spring holders 47 of the grill cover 43 and the spring couplers 53 of the grill cover casing 41 are provided a pair of springs 55, elastically biasing the grill cover 43, by coupling one end thereof to the spring holder 47 and the other end thereof to the spring coupler 53. In the middle of the grill cover casing 41 is formed a bracket 65 taking a shape of "U." One side of the bracket 65 is opened toward the grill cover 43, and the other side thereof is coupled to the grill member 35.

Referring to FIG. 3, the switch 61 installed between the grill member 35 and the grill cover 43, is comprised of an AC motor 63, cams 67, 71 and 73 and micro switches 75 and 77. The AC motor 63 is activated to open and close the grill cover 43.

The motor 63 is mounted on one side of the bracket 65, and a main cam 67 is installed on a rotational shaft of the motor 63. The main cam 67 is accommodated within the bracket 65, taking an approximately elliptical shape having different curvature radii, and is rotated by an operation of the motor 63. An outer circumference portion of the main cam 67 is contacted with the main cam contact groove 51 formed on the grill cover 43. Under the state that the grill cover 43 is closed, an outer circumference of a protrusion part 67*a* having the maximum curvature radius, that is, the point where one end of the main cam 67 is positioned the farthest from the center of gyration, is directed toward the grill member 35.

Outside of one side wall of the bracket 65 is provided a first auxiliary cam 71 and a second auxiliary cam 73 extended axially from the main cam 67. The first auxiliary cam 71 is of an approximately elliptical shape and has a protrusion part 71*a* having the minimum curvature radius; and the second auxiliary cam 73 is of the same shape and dimension as that of the first auxiliary cam 71 and has a protrusion part 73*a* disposed opposite to the protrusion part 71*a* of the first auxiliary cam 71. The first and second micro switches 75 and 77 having terminals respectively contacting the protrusion parts 71*a* and 73*a* of the first and second auxiliary cams 71 and 73 are disposed in parallel with each other. Each of the micro switches 75 and 77 is supported by an outer side of the bracket 65. Under the state that the grill cover 43 is closed, the outer circumference of the protrusion part 71*a* of the first auxiliary cam 71 is in contact with the terminal of the first micro switch 75, and the protrusion part 73*a* of the second auxiliary cam 73*a* opposite to the protrusion part 71*a* of the first auxiliary cam 71 is spaced from the terminal of the second micro switch 77.

Figure 4:
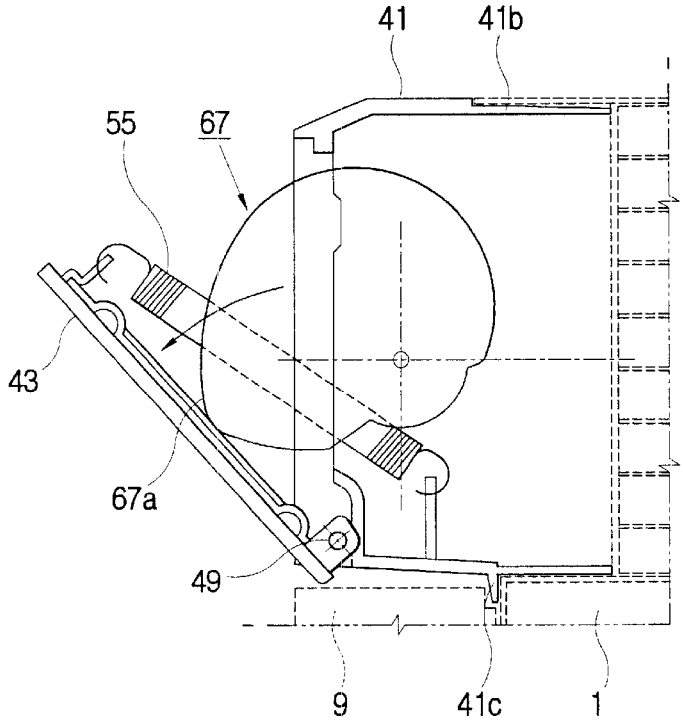
FIGS. 4 and 5 are views showing open and close states of the grill cover.
Figure 5:
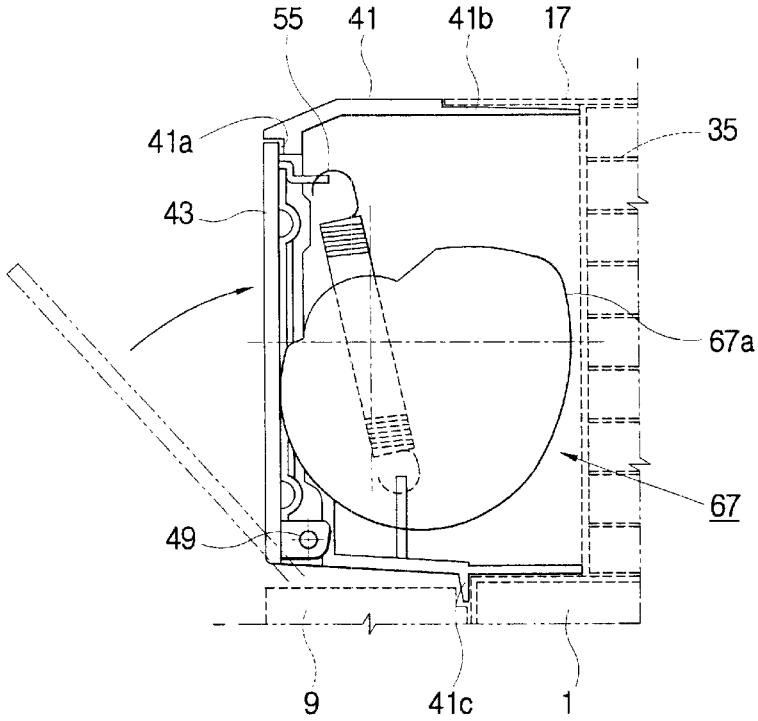
Figure 6:
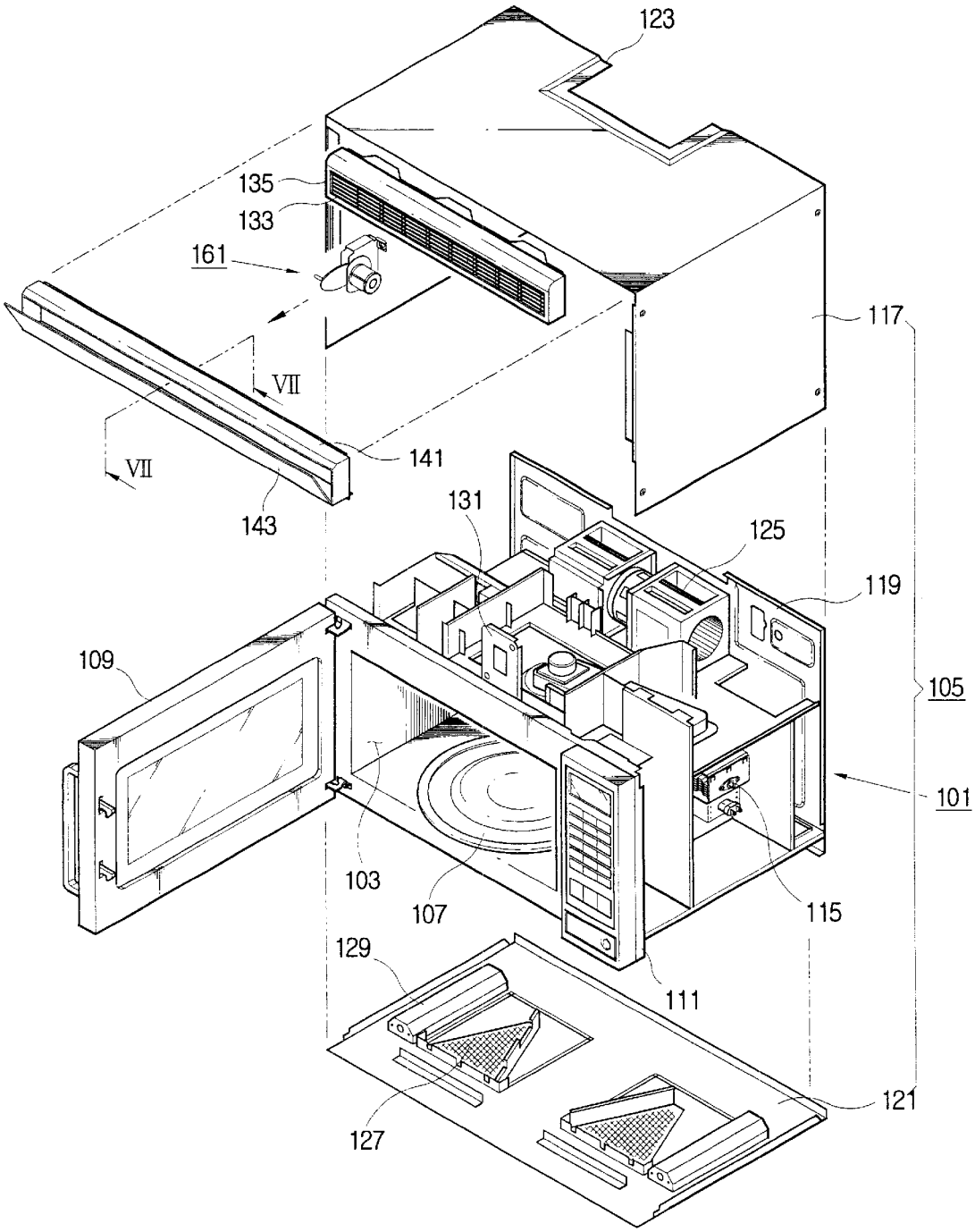
FIG. 6 (PRIOR ART)
FIG. 6 is an exploded perspective view of a conventional wall-mounted microwave oven.
Figure 7:
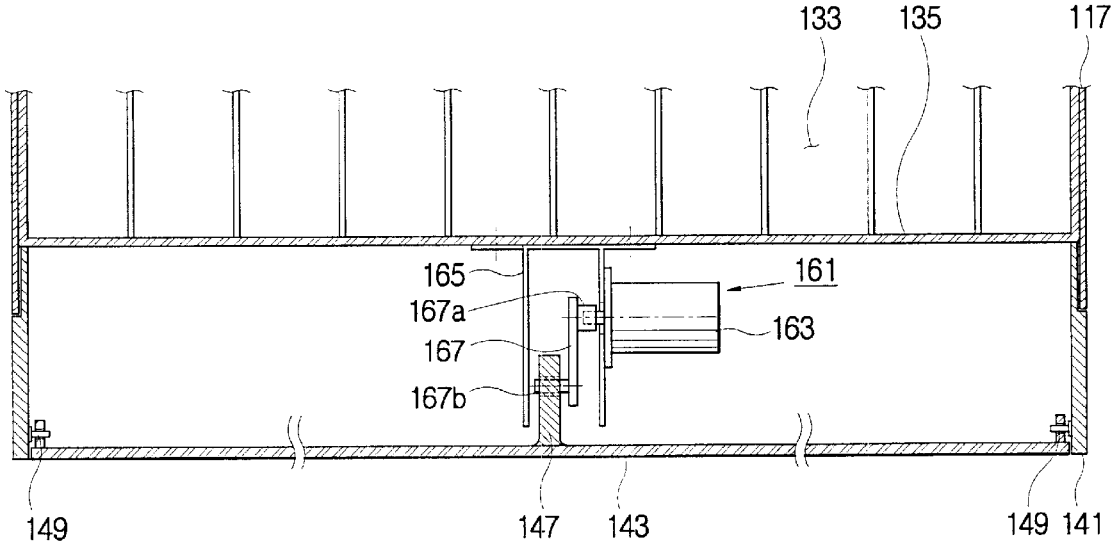
FIG. 7 (PRIOR ART)
FIG. 7 is a partial sectional view showing an installation state of a grill cover and a switch of FIG. 6.
Figure 8:
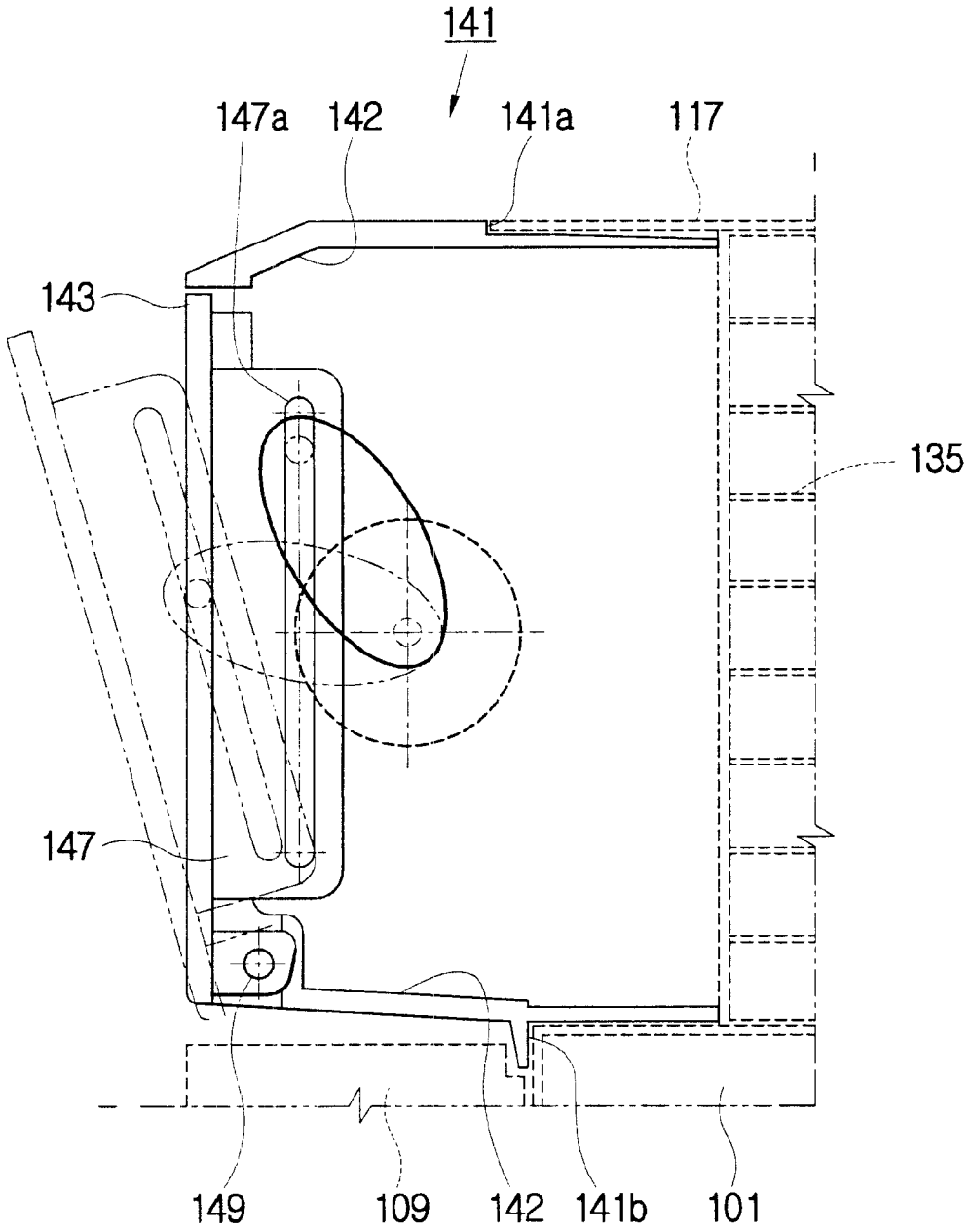
FIG. 8 (PRIOR ART)
FIG. 8 is a view showing open and close states of the grill cover.

Referring to FIGS. 4 and 5, the switching operation of the grill cover will be described in more detail.

As shown in FIG. 4, where grill cover 43 is closed, if AC motor 63 is operated according to a signal from the controller (not shown), the outer circumference of main cam 67 coupled to the rotational shaft of motor 63 is moved along main cam contact groove 51. As the outer circumference of main cam 67 is rotatably moved along main cam contact groove 51, grill cover 43 is slowly rotated forward around hinges 49 to thereby open grill cover casing 41. When the outer circumference of protrusion 67*a* of main cam 67 directed toward grill member 35 contacts main cam contact groove 51, grill cover 43 is elastically biased by the pair of springs 55 connecting grill cover casing 41 and grill cover 43; this allows grill cover 43 to be partially opened by a predetermined degree, rather than being opened completely.

The first auxiliary cam 71, in the state that the outer circumference of the protrusion part 71*a* is in contact with the terminal of the first micro switch 75 when the grill cover 43 is closed, is rotated according to the rotation of the main cam 67. The terminal of the first micro switch 75 and the outer circumference of the first auxiliary cam 71 are accordingly separated from their mutual contacting state. To the contrary, the second auxiliary cam 73, at the opposite position to the first auxiliary cam 71 when the grill cover 43 is closed, is rotated according to the rotation of the main cam 67, and the outer circumference of the protrusion part 73*a* of the second auxiliary cam 73 becomes in contact with the terminal of the second micro switch 77. When the second auxiliary cam 73 and the terminal of the second micro switch 77 are contacted with each other, a contact signal is transmitted to the controller (not shown). Then, the controller identifies from the contact signal the maximum open state of the grill cover 43, and transmits a signal to suspend the operation of the AC motor 63. Upon receiving the suspension signal, the motor 63 immediately suspends its operation, to thereby allow the grill cover 43 to remain at its maximally opened state.

Referring to FIG. 5, where the opened grill cover 43 is closed from the open state, if the motor 63 is operated according to an operation signal inputted from the controller (not shown), the main cam 67 coupled to the rotational shaft of the motor 63 is rotationally moved along the main cam contact groove 51. The protrusion part 67*a* of the main cam 67 is slowly separated from the main cam contact groove 51 and directed toward the grill member 35. The grill cover 43 is slowly rotated toward the grill member 35 by an elastic power of the pair of springs 55 coupled to the grill cover casing 41 and the grill cover 43, contacting the grill cover accommodating groove 41*a* to thereby close the grill cover casing 41.

While the closing operation of the grill cover 43 is being conducted, the protrusion part 73*a* of the second auxiliary cam 73 and the terminal of the second micro switch 77 are slowly separated from the contacting state, whereas the protrusion part 71*a* of the first auxiliary cam 71 and the terminal of the first micro switch 75 is slowly contacted with each other from their separation state. If the first auxiliary cam 71 and the terminal of the first micro switch 75 are contacted, a contact signal is sent to the controller (not shown). Then, the controller identifies the close state of the grill cover 43 based on the contact signal and transmits a suspension signal to the motor 63. When the suspension signal is applied to the motor 63 by the controller, the motor 63 immediately suspends its operation, thereby allowing the grill cover 43 to be maintained at the close state.

Even if the user arbitrarily opens the grill cover 43 by hand, this causes no damages to the motor 63, the main cam 67, the first auxiliary cam 71 and the second auxiliary cam 73 by means of the elastic force of the springs 55 provided between the grill cover casing 41 and the grill cover 43.

According to the present invention, a main cam and auxiliary cams are provided for opening and closing the grill cover, the main cam is rotated by an AC motor, and a rotation of the main cam is controlled in cooperation with a connection of the auxiliary cams and micro switches. With this configuration, the switching operation is facilitated, the range of switching operation is constant, and the cost of production is reduced.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A microwave oven comprising a main body formed with a cooking compartment, an outer casing surrounding the main body, to define an outer appearance of the microwave oven, a grill member provided between the main body and the outer casing, having a number of air passing holes, and a grill cover rotatably provided in front of the grill member, opening and closing the grill member, further comprising:

a main cam rotatably contacting with a rear face portion of the grill cover;

a motor moving the main cam; and a switch sensing a rotational position of the main cam, the rotational position of the main cam being controlled to control the opening/closing operation of the grill cover when the motor operates.

2. The microwave oven according to claim 1, further comprising a spring positioned at the rear of the grill cover, elastically biasing the grill cover to move from the open position to the closed position.

3. The microwave oven according to claim 1, further comprising a plate reinforcing the rear face of the grill cover.

4. The microwave oven according to claim 3, further comprising a spring positioned at the rear of the cover, elastically biasing the cover to move from the open position to the closed position.

5. A microwave oven comprising:

a main body formed with a cooking compartment;

an outer casing surrounding the main body to define an outer appearance of the microwave oven;

a grill member positioned between the main body and the outer casing, perforated by a number of air holes;

a cover rotatably mounted in front of the grill member, opening and closing the grill member;

a main cam rotatably contacting with a rear face portion of the cover;

a motor moving the main cam; and a switch sensing a rotational position of the main cam, said switch comprising:

a first switch suspending operation of the motor when the main cam is rotated to a degree corresponding to an open position of the cover; and a second switch suspending operation of the motor when the main cam is rotated by a predetermined degree from the open position to a closed position of the cover.

6. The microwave oven according to claim 5, further comprising first and second auxiliary cams to respectively activate the first and second switches when the main cam is rotated to the degree corresponding to open and closed positions of the cover.

7. The microwave oven according to claim 6, wherein the main cam, the first auxiliary cam and the second auxiliary cam are arranged coaxially.

8. The microwave oven according to claim 5, further comprising a spring positioned at the rear of the cover, elastically biasing the cover to move from the open position to the closed position.

9. The microwave oven according to claim 5, further comprising a plate reinforcing the rear face of the cover.

10. The microwave oven according to claim 9, further comprising a spring positioned at the rear of the cover, elastically biasing the cover to move from the open position to the closed position.

11. A microwave oven comprising:

a main body formed with a cooking compartment;

an outer casing surrounding the main body to define an outer appearance of the microwave oven;

a grill member positioned between the main body and the outer casing, perforated by a number of air holes;

a cover rotatably mounted in front of the grill member, opening and closing the grill member;

a main cam rotatably contacting with a rear face portion of the cover;

a motor moving the main cam;

a switch sensing a rotational position of the main cam; and an auxiliary cam to activate the switch when the main cam is rotated to a degree corresponding to an open and closed position of the cover.

12. The microwave oven according to claim 11, said switch comprising:

a first switch suspending operation of the motor when the main cam is rotated to a degree corresponding to an open position of the cover; and a second switch suspending operation of the motor when the main cam is rotated by a predetermined degree from the open position to a closed position of the cover.

13. The microwave oven according to claim 12, said auxiliary cam comprising first and second auxiliary cams to respectively activate the first and second switches when the main cam is rotated to the degree corresponding to open and closed positions of the cover.

14. The microwave oven according to claim 13, wherein the main cam, the first auxiliary cam and the second auxiliary cam are arranged coaxially.

15. The microwave oven according to claim 11, further comprising a spring positioned at the rear of the cover, elastically biasing the cover to move from the open position to the closed position.

16. The microwave oven according to claim 11, further comprising a plate reinforcing the rear face of the cover.

17. The microwave oven according to claim 16, further comprising a spring positioned at the rear of the cover, elastically biasing the cover to move from the open position to the closed position.

* * * * *